US006559774B2

(12) United States Patent
Bergan et al.

(10) Patent No.: US 6,559,774 B2
(45) Date of Patent: May 6, 2003

(54) DYNAMIC WORK ZONE SAFETY SYSTEM AND METHOD

(75) Inventors: Terry Bergan, Saskatoon (CA); Rod Klashinsky, Saskatoon (CA)

(73) Assignee: International Road Dynamics Inc., Saskatoon (CA)

( * ) Notice: Subject to any disclaimer, the term of this patent is extended or adjusted under 35 U.S.C. 154(b) by 123 days.

(21) Appl. No.: 09/893,613

(22) Filed: Jun. 29, 2001

(65) Prior Publication Data

US 2002/0175831 A1 Nov. 28, 2002

(30) Foreign Application Priority Data

Apr. 6, 2001 (CA) ..... 2343435

(51) Int. Cl.[7] ..... G08G 1/095

(52) U.S. Cl. ..... 340/908; 340/908.1; 340/907; 340/933

(58) Field of Search ..... 340/908, 908.1, 340/907, 925, 928, 929, 932, 933, 934, 935, 936, 540, 541, 905

(56) References Cited

U.S. PATENT DOCUMENTS

| | | | | | |
|---|---|---|---|---|---|
| 3,938,080 | A | * | 2/1976 | Hulme | 340/908.1 |
| 5,552,767 | A | | 9/1996 | Toman | 340/540 |
| 5,610,599 | A | | 3/1997 | Nomura et al. | 340/931 |
| 5,661,474 | A | | 8/1997 | Douglas | 340/940 |
| 5,673,039 | A | | 9/1997 | Pietzsch et al. | 340/905 |
| 5,696,502 | A | | 12/1997 | Busch et al. | 340/905 |
| 5,729,214 | A | | 3/1998 | Moore | 340/905 |
| 5,760,686 | A | | 6/1998 | Toman | 340/540 |
| 5,900,826 | A | | 5/1999 | Farber | 340/908 |
| 6,064,318 | A | * | 5/2000 | Kirchner, III et al. | 340/905 |
| 6,320,515 | B1 | * | 11/2002 | Olsson | 340/905 |

* cited by examiner

*Primary Examiner*—Benjamin C. Lee
(74) *Attorney, Agent, or Firm*—Nixon & Vanderhye P.C.

(57) ABSTRACT

A novel dynamic work zone safety system and method of traffic control for a construction work zone are provided herein. The system includes at least two traffic signalling device which are positioned along a roadside immediately upstream of a point where traffic is diverted to a single lane. The traffic signalling devices selectively flash a suitable warning, e.g., "DO NOT PASS" or "MERGE LEFT" or "MERGE RIGHT", thereby to provide at least two "NO PASSING" or "MERGE LEFT" or "MERGE RIGHT" zones which is defined by the distance between the traffic signalling devices and the end of the work or construction zone. The "NO PASSING" or "MERGE LEFT" or "MERGE RIGHT" zones traffic signalling device and the end of the work or construction zone may thus be expanded or contracted. A plurality of spaced-apart sensors is disposed along the roadway both downstream of, and upstream of, the traffic signalling devices to detect and determine the length of traffic queues upstream of the traffic signalling devices, and provides signals which are representative of the length of the traffic queues. The processor receives the traffic queue signals and generates activation signals when the traffic queue reaches a predetermined length. It also generates a deactivation signal when the traffic queue is less than the predetermined length. This dynamically increases or decreases the "NO PASSING" or "MERGE LEFT" or "MERGE RIGHT" zone.

19 Claims, 4 Drawing Sheets

DYNAMIC WORK ZONE SAFETY SYSTEM AND METHOD

BACKGROUND OF THE INVENTION (a) Field of the Invention

The present invention relates to a traffic control system and method for construction work zones.

(b) Description of the Prior Art

Traffic accidents on a given section of roadway greatly increase while road work is performed in or near the roadway section. A work zone safety system is intended to reduce accidents at a construction zone. When traffic moves slowly, it is instinctive for motorists to attempt to pass slower moving vehicles in order to decrease the time of their journey. This instinct can lead to problems in a work zone because one lane is closed due to construction. In a work zone, the passing motorist will likely have difficulty re-entering traffic which may lead to an accident with another vehicle or an accident with the construction crew.

Lane restrictions, traffic speed fluctuations, bi-directional traffic flow, vehicles entering and exiting the roadway, and the general distracting surroundings of a work zone contribute to the propensity of accidents in and around roadway work zones. This propensity for accidents poses a very real risk to road construction crews, utility crews, maintenance workers, and other personnel in the vicinity of a work zone. It is not uncommon for accident rates to increase about 50% or more during times of constructions, and these accidents are increasingly causing injury and death to work zone personnel. Along with the human tragedy of the increased work zone related injuries and deaths, contractors suffer economically as well from worker's compensation rate increases, (in Canada) increased tort liability, and decreases in worker productivity and morale as work zone personnel pay greater attention to oncoming traffic and less attention to their work assignments.

Various devices and techniques are known which attempt to alert drivers to approaching roadway hazards. These devices were designed to make drivers more aware of their surroundings and/or to reduce the speed of vehicles approaching roadway hazards. These prior art techniques included: regulatory and advisory signage; dynamic speed limit signage; mock-up police cars; high visibility clothing; and traffic flow diversion devices, to name but a few. While these prior art devices and techniques undoubtedly deterred countless additional work zone related accidents, those devices were directed solely at alerting drivers of an approaching hazard. Those devices had no way to warn work zone personnel if, or when, a vehicle strayed from a designated traffic lane and breached the work zone perimeter.

One device, however, which was well-known, attempted to signal highway workers when an errant vehicle entered the work zone. The device included an infrared signal with a reflective cone, or an ultrasonic beam, to detect a vehicle passing thereby. The infrared signal or ultrasonic beam was positioned "upstream" from the work zone and was placed at about 90° to the oncoming traffic. This detector was in communication via a wireless data link to a siren of about 120 decibel which was positioned within the work zone. When a vehicle was detected upstream, a signal was transmitted to the siren and the siren sounded an audible warning. Another embodiment of this device used a pneumatic tube which was laid across the roadway in place of the infrared or ultrasonic beam. However, the harsh environment of the roadway work zone proved too large an obstacle for this device efficiently to warn workers.

The problems with this warning device were numerous. First, most work zones were very noisy. In addition to the traffic noise and wind along any stretch of roadway, many work zones used heavy construction machinery, and jack hammers, shot blaster, and concreted cutters which create a tremendous amount of noise. Because the U.S. Occupational Safety and Health Administration ("OSHA") standards required operators of this machinery to wear hearing protection, the operators were unable to hear the audible warning over the noise of the equipment they were operating and through their hearing protection. Further, even without hearing protection, personnel in the vicinity of this machinery and equipment often did not hear the audible warning.

Secondly, this warning device suffered several integrity problems. Because the device used a single detector positioned "upstream" from the work zone and at about 90° to approaching traffic, it was possible for vehicles to enter the work zone without tripping the detector. Moreover, the heat and audible noise produced by work zone equipment and passing traffic would interfere with such infrared and ultrasonic detectors, thereby causing false detections. Further, the distance between the detector and the siren necessitated a wireless data link therebetween. Modern work zones are flooded with electromagnetic noise within the popular communication frequencies. The frequent use of walkie-talkies by work zone personnel, portable and cellular telephones by work zone personnel and passing traffic, and CB and short wave radio by passing vehicular and air traffic would trigger the siren causing a significant problem with false alarms. Furthermore, this transmission required FCC compliance as well.

Other devices intended for alerting work zone personnel to vehicles breaching the work zone perimeter relied on audible alarms, despite the high level of noise which pervade the work zones, and despite OSHA regulations relating to hearing protection which substantially degraded the effectiveness of audible alarms. Although several of the devices which alerted drivers, rather than personnel, to approaching roadway hazards employed a variety of rotating and/or flashing lights to attract the drivers' attention, such lights have never been used to convey information to the work zone personnel. This was perhaps for two reasons. Firstly, most believed that, by working in a roadway work zone where numerous flashing signs and rotating lights were present for alerting drivers to the presence of the work zone, the work zone personnel had become immune to optical warning signals, and cannot readily distinguish a typical warning light for alerting drivers from a warning light for alerting the personnel of a hazard. Secondly, because the attention of the work zone personnel was supposed to be on the task they were paid to perform, one cannot realistically have expected the worker to be looking in the direction of a warning light at all times for quickly perceiving a warning signal. For example, if a typical rotating incandescent light was used to convey the intrusion of a vehicle into the work zone, it was highly probable that a worker operating a jack hammer would be looking down and away from the light while performing this task, and thus would not perceive the warning signal at all, or at least not within sufficient time to evacuate the work zone or otherwise evade the approaching vehicle.

Generally, in the event that vehicles alternately passed on one-side road section under construction from opposite directions, traffic signals were temporarily provided at both ends of the section, thereby conducting a traffic control. One of the representative systems of such prior art was one wherein traffic signals and detector means, e.g., pressure sensors at both ends of the section were provided for detection of the number of vehicles passing therethrough, thus extending the lighting time of green signals at the heavier traffic end. A signal controller circuit included a signal device which changed indication of signals by means of vehicle detector means, e.g., light sensor or the like provided adjacent to the signals. Further, a system was disclosed for alternately switched traffic signals controller device having a set of traffic signals which was so operated that while one traffic light at passage allowed end was green, the other traffic signal at no passage allowed end was red or against and detector means were provided for detection of vehicles passing through the section. Furthermore, a traffic signal device was also provided at both ends of a road section under construction. It was, moreover, difficult to allow vehicles from opposite directions efficiently to pass the section to shorten the waiting time of vehicles. Further, according to the above prior art, the waiting time will become still comparatively long, thus easily causing traffic jams when traffic density was distinctly large at one side than at the other side in the road repairing section.

In addition, sensitive systems were employed for control of the lighting of the traffic signals based on the detection of vehicles by the detector means, e.g., pressure sensor, light sensor or the like, the control systems for traffic signals could be damaged in case of troubles in the detector means. Furthermore, as such signal systems were usually still in operation even at night when no vehicles were found, there will sometimes be no input of detection signals for more than a preset time. In such case, it cannot be concluded merely from the fact of no traffic that the detector means were out of order. Additionally, vehicles from the opposite directions will be exposed to great danger of head-on collision in the case that a vehicle enters the section against a red signal immediately after the change to red from green, while another vehicle also enters the section because of the signal change to green from red before the passing of the opposite vehicle.

Portable traffic control systems particularly suited to controlling traffic in work areas have also been disclosed. Normally, the systems were used on roads that had two traffic lanes, each lane being for traffic in a different direction. When repair work was being performed on one lane of the road, however, the traffic in both directions must use the other lane. The control systems employed traffic lights at each end of the traffic lane, alternately presenting a "go" signal first to traffic from one direction and then to traffic from the other direction. The signals were viewable not only by oncoming traffic but also by an operator standing between the display units.

This warning device also suffered from several integrity problems. The heat and audible noise produced by work zone equipment, passing traffic, and other conditions of the work zone environment were capable of interfering with the infrared or ultrasonic detector in such a way that the detector could fail to detect a vehicle passing through the detection beam. Because the detector was designed to sense the presence or absence of a reflected detection beam, the detector was susceptible to detecting the heat or noise produced in the work zone as the reflected detection beam, even when the detection beam was obstructed by a vehicle entering the work zone. This was particularly true where the detector employed a continuous infrared signal, as it was difficult infrared energy. Thus, the potential always existed for a vehicle to pass through the detection beam without sounding the alarm, and without any warning to the work zone personnel.

Additionally, airborne particulate matter, birds, precipitation, and drifting debris could sporadically interrupt the constant signal or beam transmitted by the detector, thereby causing false detections which resulted in a loss of credibility for the device and costly work stoppages. Further still, the distance between the detector and the siren necessitated a wireless data link therebetween (which itself required FCC approval).

Another known device was intended to alert work zone personnel when a vehicle entered the work zone. While the earlier device employed a single detection beam that was positioned upstream from the work zone and was oriented perpendicular to oncoming traffic, the later device was configured to detect the intrusion of a vehicle into the work zone along any section of the work zone perimeter adjacent to an active traffic lane. An infrared source was placed at the beginning of the work zone which transmitted a continuous wave infrared signal along the perimeter of the work zone for reception by an infrared detector positioned downstream. If a vehicle passed between the source and the detector, thereby interrupting the continuous wave infrared signal transmitted therebetween, the detector would acknowledge this obstruction by sounding an alarm. However, this device also suffered numerous problems in operation.

Firstly, because a continuous wave infrared signal was employed, filters could not be used in the receiver to remove low frequency infrared noise without also removing the infrared signal to be detected. Nor could filters be used in the receiver electronics to remove electromagnetic noise emanating from sources within or proximate to the work zone. The range of the device was therefore unduly limited, as the detector could not be placed more than about 750 feet from the infrared source and still reliably distinguish the continuous infrared signal from other infrared energy present in the work zone. Given that typical roadway work zones have a length well in excess of about 750 feet, an unacceptably large number of infrared sources and detectors had to be used in order to detect breaching vehicles along the entire perimeter of the work zone adjacent to active traffic lanes. Moreover, because the infrared source had to transmit a focussed and narrow beam in order to have a detectable range of about 750 feet, the infrared detector had to be precisely positioned in the line of sight of the infrared source to receive the transmitted beam. The infrared detector was therefore difficult to set up and align along the work zone perimeter, and was not amenable to being moved frequently from work zone to work zone. This lack of portability was further amplified where numerous infrared sources and detectors had to be employed. The infrared detector could also be fooled into detecting a stray infrared signal as the constant infrared beam so that a vehicle could pass into the work zone undetected. Further still, this device, like all other prior art devices, employed an audible alarm for signalling personnel of an errant vehicle, the significant drawbacks of which were described above.

In addition, currently, systems which are used in controlling traffic conditions around work zones and incidents on the road are limited to the use of conventional static signs, flashing arrow signs, portable variable message signs (VMS) programmed with a single repeating message, or no signs at all. These systems provide little or no information which are useful to drivers either for avoiding the development of a traffic jam or for finding alternative routes. Though portions of the highways close to large metropolitan areas are often equipped with permanently installed VMSs and traffic signal lights designed to control the in-flow or out-flow of traffic in the highways, there are large stretches of highways that lack nay facilities for controlling the flow of traffic on the highway that are usable around work zones or incidents on the road. Rather, the same conventional equipment as described above are used and provide the same limited information to drivers. Even if permanently installed VMSs are available, current methods in the use of such devices also provide very limited information for drivers in avoiding traffic jams due to the presence of work areas and/or roadside incidents, and such information is not credible because the messages they convey are typically not appropriate to existing conditions.

Representative of the above prior art include the following patents.

U.S. Pat. No. 5,552,767,issued Sep. 6, 1996 to Toman, disclosed a warning system that alerted road system which used microwave transmitter sensor pairs positioned along the perimeter of a work zone. An optical warning device, e.g., a strobe light, was activated if the microwave beam between successive sensor pairs was broken. This patent provided an assembly for detecting and signalling when an object entered a work zone, including a plurality of transmitter sensors pairs serially connected along a section of the work zone perimeter for detecting when an object passed therethrough. Once an object was detected, an optical warning signal was activated. The optical warning signal included a primary strobe and a plurality of relay strobes positioned throughout the work zone. The primary strobe was positioned throughout the work zone, and it flashed at a predetermined flash rate which was detected by a photoelectric sensor in a nearby relay strobe. The nearby relay strobe began flashing at the predetermined flash rate thereby activating another relay strobe in close proximity. This cascading strobe effect saturated the work zone.

U.S. Pat. No. 5,610,599, issued Mar. 11, 1997 to Nomura, disclosed a traffic signal control system for use in bi-directional flow control around a construction zone. The system consisted of traffic lights at either end of the construction zone attached to a central controller. Sensors, e.g., pressure sensitive strips, were located at both ends of the construction zone and were attached to the controller. Each light was programmed with a minimum and maximum green light time. The light was initially activated for the minimum time. If heavy traffic was detected, the green light was extended for further incremental periods until the maximum time was reached. Thus, this patent provides a system for traffic signals for one-side passing. It included two-position signals temporally provided at both ends of a road repairing section through which vehicles from up lane and down lane alternately passed. Detector means were provided for detection of passage of vehicles at both ends of the road repairing section, each corresponding to each traffic signal. A sensitive controller device was provided for control of green or red lighting time and switching of red or green indication of the traffic signals based upon detection signals by the detector means. The sensitive controller was provided for cycled lighting of the traffic signals, one cycle consisting of green-red, red—red, red-green and red—red lighting in sequence of each traffic signal. A uniformly red time extension means was provided for extending the uniformly red time by a preset detection time, if a detection signal was inputted by the detector means of one traffic signal switching from green to red by the sensitive controller device within the preset detection time after such switching.

U.S. Pat. No. 5,673,039, issued Sep. 30, 1997 to Pietzch et al, disclosed a traffic and road condition monitoring system that can be disposed along a roadway. The system included multiple traffic and/or load-sensing sensors arrayed along the road to detect vehicle speed, traffic conditions, traffic violations, lane occupancy, etc. The processed output from the sensors controlled a series of flashing lights and/or alpha-numeric displays in accordance with the detected conditions. The patent thus provided an arrangement for monitoring vehicular traffic and providing information and warnings to drivers of traffic disruptions, driver error, dangerous road conditions, and severe weather. Road and traffic conditions were detected with roadside traffic sensing equipment, and the conditions were displayed over luminescent elements with signal lamps distributed at intervals along the road and combined into chains of lamps. The luminescent elements were illuminated simultaneously or in sequence for providing continuous traffic information. A processor network and a signal network were combined through a communication network to regulate the luminescent elements by processing, if necessary, under real time controlled conditions.

U.S. Pat. No. 5,661,474, issued Aug. 26, 1997 to Douglas, disclosed a construction zone intrusion detection system. The system consists of a pressure sensitive strip that was laid around the construction zone. If a vehicle passed over the strip, alarm was sounded to warn the construction crew.

U.S. Pat. No. 5,696,502, issued Dec. 9, 1997 to Busch et al, disclosed a traffic detection method using fuzzy logic to assess and predict traffic conditions dynamically. Thus, this patent provided a method of sensing traffic and detecting traffic situations on roads. Measuring points were set up for the purpose of vehicle detection using traffic sensors. A traffic data processing arrangement was provided for traffic control, at regular intervals, traffic data as vehicle speed, traffic intensity and traffic density was determine and traffic parameters determined therefrom were formed in a traffic data processing system. Two adjacent measuring points, formed a measuring section of a given length. The following traffic parameters were formed from the traffic data of two such measuring points: the speed density difference, which was calculated from the local traffic data of average speed and traffic density; a trend factor, which was formed continually from the ratio between the traffic intensities of the first and second measuring points but determined during a given period in the minute range; and the traffic intensity trend of the respective measuring point, that trend being derived on the basis of the function of the traffic intensity over the time from the increase of the tangent to the curve. The probability of a critical traffic situation was derived therefrom in a fuzzy logic.

U.S. Pat. No. 5,729,214, issued Mar. 17, 1998 to Moore, disclosed a traffic signalling system that consisted of roadside sensors for detecting traffic conditions, weather conditions, etc., a central processing station to which the detected conditions are transmitted and processed, and signals controlled by the central processing station in response to the detected conditions. This system permitted dynamic monitoring of traffic conditions, and selective display of messages to motorists depending on the conditions. This was a particularly complex system employing satellite communication of the detected conditions to a remote central processing stations.

U.S. Pat. No. 5,760,686, issued Jun. 2, 1998 to Toman, disclosed a portable warning system that alerted road construction crews to vehicles that have breached a construction perimeter. Thus, this patent disclosed an apparatus for detecting and signalling when a vehicle entered, or posed a serious risk of entering, a roadway work zone. The apparatus comprised an intrusion detector array for detecting a vehicle breaching the work zone perimeter, and a high intensity strobe light array for providing an optical warning signal when the perimeter breaching vehicle was detected. The detector array included one or more transmitters for emitting pulsed infrared signals along the work zone perimeter, and one or more receivers for detecting the presence or absence of the pulsed infrared signals. The receivers included filters for removing stray signals emanating from sources other than the transmitters. The strobe light array included a primary strobe activated by the detector array when a perimeter breaching vehicle was detected, and several relay strobes which were activated by the optical warning signal emitted by the primary strobe or another relay strobe. The primary and relay strobes emitted a high intensity, psychologically-proactive optical warning signal that was capable of immediate perception by work zone personnel despite the presence of noise and distractions. The detector array may also include a pneumatic hose assembly, and the assembly may include an electromagnetic emitter for falsely conveying the presence of a police radar trap. The electromagnetic emitter may be embodied in an excessive speed module for detecting a vehicle approaching the work zone at an excessive speed, and for activating the strobe light array upon detecting the speeding vehicle.

U.S. Pat. No. 5,900,826, issued May 4, 1996 to Farber, disclosed a signalling system for controlling two-way traffic flow around a construction zone. The system consisted of two traffic lights at opposite ends of a construction zone that were alternately activated to give a green light to oncoming traffic. The lights communicated through a wireless link. The lights were also provided with sensors that detect whether a vehicle is attempting to go through on a red light. When such a vehicle is detected, an audible warning signal is activated. Thus, this patent disclosed a portable control comprising two display units, each responsive to a transmitter's radio signals, each display unit comprising a "stop" lamp and a "go" lamp, the light from all lamps being viewable by a person positioned between the display units. The system was optionally equipped with an audio warning means for detecting vehicles that ignore a display unit stop light, the display units each preferably employing a simplified circuit with a servo motor mechanism.

U.S. Pat. No. 6,064,318, issued May 16, 2000 to Kirchner, III et al, disclosed a portable traffic advisory system that monitored current traffic conditions in the vicinity of a construction zone or accident. The system consisted of a plurality of wireless sensors which were positioned along the roadway to detect traffic conditions, e.g., traffic speed and density, and at least one display device that can display a variety of messages depending on the detected traffic conditions. One feature of this system was the portable and repositionable nature of the sensors and displays. This system was mainly intended to provide real time traffic information to motorists. Thus, this patent was directed to a portable system for automatic data acquisition and processing of traffic information in real-time. The system incorporated a plurality of sensors operatively positioned upstream of a work zone or roadway incident with each of the sensors being adapted to detect current traffic conditions. At least one variable message device was positioned upstream of the work zone or roadway incident. A plurality of remote station controllers were provided, each being operatively connected to the plurality of sensors and the variable message device. A central system controller was located within remote communication range of the remote station controllers. The central system controller and the plurality of remote station controllers were capable of remotely communicating with one another. Each of the sensors was adapted to output traffic condition data to its corresponding remote station controller. The corresponding remote station controllers then transmitted the traffic condition data to the central system controller. The central system controller automatically generated traffic advisory data based on the traffic condition data and transmitted the traffic advisory data to the remote station controller that was connected to the variable message device. The traffic advisory data may also be used to communicate with and control highway advisory radio transmitters and ramp metering stations. Together, one or more variable message devices, highway advisory radio transmitters and ramp metering stations may be used to inform passing motorists of traffic conditions in and around a work zone or roadway incident, and thereby control and improve the safety and efficiency of traffic operations around such sites.

SUMMARY OF THE INVENTION (a) Aims of the Invention

Accordingly, it is a main object of the present invention to provide a system for traffic signals for one-side passing which can reduce the waiting time of vehicles and allow them efficiently to pass a road section under construction.

It is another object of the present invention to provide a system for traffic signals for one-side passing which can ensure the safety passage by vehicles in the road section at the time of signal changes.

It is yet another object of this invention to create a dynamic "NO PASSING" zone based on traffic occupancy, which will change due to traffic occupancy, and which should discourage drivers from passing when the occupancy ahead is too high making merging safer.

(b) Statement of Invention

The present invention generally provides traffic monitoring and warning systems and methods, particularly for controlling suitable warning, e.g., "DO NOT PASS" or "MERGE LEFT" or "MERGE RIGHT" indicators immediately prior to construction zones. Dangerous and aggressive merging just before a lane restriction around a construction zone can result in accidents in the work zone, and, potentially, fatalities among the construction crews.

This invention provides a dynamic work zone safety system which includes a first traffic signalling device which is positioned along a roadside immediately upstream of a point where traffic is diverted to a single lane. The first traffic signalling device is defaulted to flash a suitable warning, e.g., "DO NOT PASS" or "MERGE LEFT" or "MERGE RIGHT" or similar message, thereby to provide a first "NO PASSING" or "MERGE LEFT" or "MERGE RIGHT" zone which is defined by the distance between the first traffic signalling device and the end of the work or construction zone. A second traffic signalling device is positioned alongside a roadside a predetermined distance upstream of the first traffic signalling device. The second traffic signalling device is defaulted not to flash a suitable warning, e.g., "DO NOT PASS" or "MERGE LEFT" or "MERGE RIGHT" or similar message. When activated to flash a suitable warning, e.g., "DO NOT PASS" or "MERGE LEFT" or "MERGE RIGHT", (by processor means to be described hereinafter), it provides a second "NO PASSING" or "MERGE LEFT" or "MERGE RIGHT" zone which is contiguous to the first "NO PASSING" or "MERGE LEFT" or "MERGE RIGHT" zone. This lengthens the "NO PASSING" or "MERGE LEFT" or "MERGE RIGHT" zone to one which is between the second traffic signalling device and the end of the work or construction zone. A plurality of spaced-apart sensors is positioned along the roadway both downstream of, and upstream of, the second traffic signalling device. These sensors detect and determine the length of a traffic queue upstream of the first traffic signalling device between the first traffic signalling device and the second traffic signalling device. The sensors provide a first traffic queue signal which is representative of the length of the traffic queue. A first processor receives the first traffic queue signal and generates a first activation signal to activate the second traffic signalling device when the traffic queue reaches a predetermined length, and generates a first deactivation signal to deactivate the second traffic signal when the traffic queue is less than the predetermined length. This thereby dynamically increases or decreases the "NO PASSING" or "MERGE LEFT" or "MERGE RIGHT" zone.

The present invention also provides a method of traffic control for a construction work zone that assists in the prevention of dangerous merging which occurs on the approaches to work zones. The method includes establishing a first "NO PASSING" or "MERGE LEFT" or "MERGE RIGHT" zone immediately upstream of a construction work zone. Traffic congestion or queues are detected and measured at a plurality of locations approaching the first "NO PASSING" or "MERGE LEFT" or "MERGE RIGHT" zone. A processor which is loaded with suitable software determines the length of a "NO PASSING" or "MERGE LEFT" or "MERGE RIGHT" zone based on the detected traffic queue. Based on that determination of the length of the traffic queue, the processor automatically, by means of the software, expands or shrinks a "NO PASSING" or "MERGE LEFT" or "MERGE RIGHT" zone upstream of the construction work zone appropriate for the measured level of traffic.

(c) Other Features of the Invention

By a first feature of this dynamic work zone safety system of this invention, the dynamic work zone safety system includes a third traffic signalling device, such traffic signalling device being positioned alongside a roadside a predetermined distance upstream from the second traffic signalling device. The dynamic work zone safety system also provides that, when the third traffic signalling device is activated, a third "NO PASSING" or "MERGE LEFT" or "MERGE RIGHT" zone is created which is contiguous to the second "NO PASSING" or "MERGE LEFT" or "MERGE RIGHT" zone, thereby to lengthen the "NO PASSING" or "MERGE LEFT" or "MERGE RIGHT" zone to between the third traffic signalling device and the end of the work or construction zone. The plurality of spaced-apart sensors further includes a first plurality of spaced-apart sensors along the roadway both upstream of, and downstream of, the third traffic signalling device to detect and determine the length of a second traffic queue upstream of the first traffic signalling device between the second traffic signalling device and the third traffic signalling device, and to provide a second traffic queue signal which is representative of the second traffic queue. The processor is also configured to generate a second activation signal to activate the third traffic signalling device when the second traffic queue reaches a predetermined length, and to generate a second deactivation signal to deactivate the third traffic signalling device when the second traffic queue is less than the predetermined length, thereby dynamically increasing or decreasing the third "NO PASSING" or "MERGE LEFT" or "MERGE RIGHT" zone.

By a second feature of this dynamic work zone safety system of this invention, the dynamic work zone safety system includes an "nth" traffic signalling device, such "nth" traffic signalling device being positioned alongside a roadside a predetermined distance upstream from the third traffic signalling device. When the "nth" traffic signalling device is activated, a fourth "NO PASSING" or "MERGE LEFT" or "MERGE RIGHT" zone is created which is contiguous to the fourth "NO PASSING" or "MERGE LEFT" or "MERGE RIGHT" zone, thereby to lengthen the "NO PASSING" or "MERGE LEFT" or "MERGE RIGHT" zone to between the "nth" traffic signalling device and the end of the work or construction zone. The plurality of spaced-apart sensors still further includes a second plurality of spaced-apart sensors along the roadway both upstream of, and downstream of, the "nth" traffic signalling device to detect and determine the length of a third traffic queue upstream of the "nth" traffic signalling device between the third traffic signalling device and the "nth" traffic signalling device, and to provide a third traffic queue signal which is representative of the third traffic queue. That processor is also configured to generate a third activation signal to activate the "nth" traffic signalling device when the third traffic queue reaches a predetermined length, and to generate a third deactivation signal to deactivate the "nth" traffic signal when the third traffic queue is less than the predetermined length, thereby dynamically increasing or decreasing the fourth "NO PASSING" or "MERGE LEFT" or "MERGE RIGHT" zone.

By a first subsidiary feature of this dynamic work zone safety system of this invention and the above features of this dynamic work zone safety system of the invention, the sensors are integrated with the traffic signalling devices.

By a second subsidiary feature of this dynamic work zone safety system of this invention and the above features of this dynamic work zone safety system of the invention, the processor is connected to the traffic signalling devices wirelessly.

By a third subsidiary feature of this dynamic work zone safety system of this invention and the above features of this dynamic work zone safety system of the invention, the sensors are solar powered.

By a third subsidiary feature of this dynamic work zone safety system of the invention and the above features of this dynamic work zone safety system of the invention, the sensors are non-intrusive. Such non-intrusive sensors may be active radar sensors, or may be passive acoustic sensors, or may be ultrasonic sensors.

By a fourth subsidiary feature of this dynamic work zone safety system of this invention, and the above features of this dynamic work zone safety system, the sensors are intrusive. Examples of such intrusive sensors include a sensor which is mounted onto the roadway and which is a pneumatic road hose, a tape switch, a piezoelectric sensor, a fiber optic sensor or a quartz sensor; a passive magnetic device, an active magnetic device of an inductive loop; and an elongated elastomeric member having an elongated pressure sensor thereon, a coaxial piezoelectric cable, a flanged tube sensor with piezoelectric plates or a DYNAX™ sensor.

By a third feature of this dynamic work zone safety system of this invention, and the above features of this dynamic work zone safety system, the processor is connected to the traffic signalling devices wirelessly.

By a fourth feature of this dynamic work zone safety system of this invention, and the above features of this dynamic work zone safety system, the sensors are at least one of solar powered and battery powered.

(d) Generalized Description of the Invention

The present invention thus provides a dynamic work zone safety system having multiple signals for defining a "NO PASSING" or "MERGE LEFT" or "MERGE RIGHT" zone, traffic sensors for detecting traffic queue length in advance of the defined "NO PASSING" or "MERGE LEFT" or "MERGE RIGHT" zone, and means for lengthening the "NO PASSING" or "MERGE LEFT" or "MERGE RIGHT" zone in response to detected traffic queue length.

In other words, the present invention provides a dynamic work zone safety system that alerts drivers that they are entering a "NO PASSING" or "MERGE LEFT" or "MERGE RIGHT" zone, and dynamically monitors current traffic conditions progressively to lengthen the "NO PASSING" or "MERGE LEFT" or "MERGE RIGHT" zone as traffic increases. For example, a first traffic signalling device is positioned along a roadside just in advance of the point where traffic tapers into a single lane. This signalling device is always activated to flash a suitable warning, e.g., "DO NOT PASS" or "MERGE LEFT" or "MERGE RIGHT". A number of similar signalling devices are positioned upstream of the first signalling device. Sensors at the roadside detect traffic queue lengths, and activate successive signalling devices dynamically to lengthen the "NO PASSING" or "MERGE LEFT" or "MERGE RIGHT" zone. In a preferred embodiment, the sensors are integrated with the signalling devices, and are solar powered.

Accordingly, the dynamic work zone safety system of this invention is comprised of a number of roadside signalling devices, traffic sensors for detecting the length of the traffic queue, software for determining how long the "NO PASSING" or "MERGE LEFT" or "MERGE RIGHT" zone should be in response to the length of the detected traffic queue, and wireless communication devices that permit successive activation/deactivation of the signalling devices. The traffic sensors can also detect vehicles passing in the dynamically signed "NO PASSING" or "MERGE LEFT" or "MERGE RIGHT" zone, and a police officer can manually issue traffic citations for such infractions.

None of the patents discussed above suggest the expedient of dynamically lengthening a "NO PASSING" or "MERGE LEFT" or "MERGE RIGHT" zone.

The present invention distinguishes over the above identified U.S. Pat. No. 5,610,707 to Nomura et al, which merely describes one type of construction zone signalling system which is responsive to traffic density. Nomura et al merely increase the duration of unidirectional flow in response to heavy traffic without lengthening a "NO PASSING" or "MERGE LEFT" or "MERGE RIGHT" zone, while embodiments of the present invention lengthen the actual "NO PASSING" or "MERGE LEFT" or "MERGE RIGHT" zone.

The present invention distinguishes over the above identified U.S. Pat. No. 5,673,039 to Pietzsch et al, who merely disclose a traffic and road condition monitoring system in which the signals can be used dynamically to warn motorists of specific upcoming traffic conditions and detected traffic violations. While Pietzsch et al disclose the activation of different numbers of signals in response to different conditions, Pietzch et al does not disclose or suggest the lengthening of a "NO PASSING" or "MERGE LEFT" or "MERGE RIGHT" zone in response to changes in a specific condition i.e. traffic density.

BRIEF DESCRIPTION OF THE DRAWINGS

In the accompanying drawings.

DESCRIPTION OF PREFERRED EMBODIMENTS

The present invention in one embodiment provides a traffic control system for construction work zones. This invention assists in the prevention of dangerous merging which occurs on the tapered approaches to work zones. Frequently, aggressive drivers pass other motorists in the lane merge area, invading the traffic stream near the taper in order to gain a slight time advantage. This dangerous practice has become quite common and is considered to be a significant cause of work zone accidents, even deaths. The present invention assists in the prevention of these types of incidents by establishing a dynamic "NO PASSING" or "MERGE LEFT" or "MERGE RIGHT" zone based on vehicle queue lengths.

Figure 1:
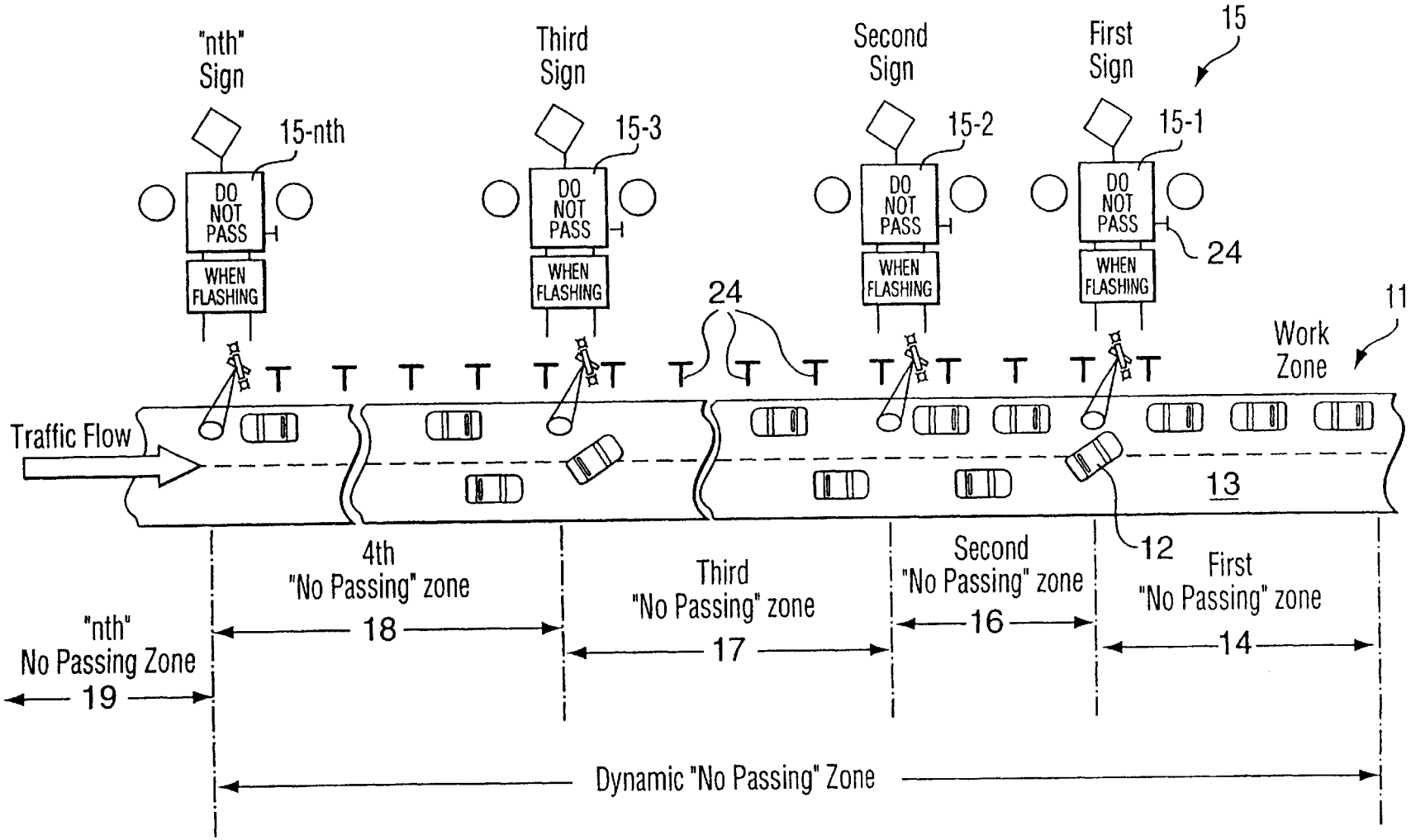
FIG. 1 is a schematic representation of one embodiment of a dynamic work zone safety system of one aspect of this invention.

(a) Description of FIG. 1

As seen in FIG. 1, construction work at zone 11 creates a lane restriction 12. on a two lane, one direction roadway 13.

A first dynamic "NO PASSING" or "MERGE LEFT" or "MERGE RIGHT" zone 14 is created just in advance of the lane restriction 12. Traffic sensors 24, which preferably are non-intrusive, which may be mounted on a traffic signalling device or sign, generally designated as the sign 15 and are used to detect traffic queue lengths. Alternatively, the traffic sensors 24 may be mounted adjacent to the roadway. The traffic sensors 24 can be any conventional sensor. The traffic signalling device or first sign 15-1 is always activated to warn of the lane restriction.

When vehicle congestion is detected at the second traffic signalling device or sign 15-2, the second warning traffic signalling device or sign 15-2 is automatically activated to provide a second "NO PASSING" or "MERGE LEFT" or "MERGE RIGHT" zone 16. When vehicle congestion is detected at the third traffic signalling device or sign 15-3, the third warning traffic signalling device or sign 15-3 will be activated to provide a third "NO PASSING" or "MERGE LEFT" or "MERGE RIGHT" zone 17. When vehicle congestion is detected at the "nth" traffic signalling device or sign **15-*n*, the "nth" traffic signalling device will be activated to provide an "nth" "NO PASSING" or "MERGE LEFT" or "MERGE RIGHT" zone 19**.

As noted, the "NO PASSING" or "MERGE LEFT" or "MERGE RIGHT" zone 19 is dynamic. Each "NO PASSING" or "MERGE LEFT" or "MERGE RIGHT" zone traffic signalling device or sign 15-1, 15-2, 15-3, **15-*n* is automatically activated/deactivated in sequence as changing conditions in vehicle congestion as determined by the traffic queue are detected by the traffic sensors 24**.

Anyone attempting to pass the waiting traffic queue and then invade the traffic stream near the taper would be subject to a traffic citation, since the "NO PASSING" or "MERGE LEFT" or "MERGE RIGHT" zone traffic signalling device or sign is an enforceable regulatory sign.

The components of the system of one embodiment of an aspect of this invention, as shown in FIG. 1, include the following:

Non-Intrusive Traffic Sensors.

In accordance with one preferred embodiment of the present invention, a radar sensor known as a RTMS (Remote Traffic Microwave Sensor) manufactured by EIS of Mississauga, Ontario, is used as the non-intrusive sensor.

The Remote Traffic Microwave Sensor (RTMS) is a true RADAR (Radio Detection And Ranging) device. As such, it provides true presence detection of vehicles in multiple zones. Its ranging capability is achieved by Frequency Modulated Continuous Wave (FMCW) operation.

In use, the sensor transmits a microwave beam and receives energy which is reflected by objects (vehicles and stationary objects) in its path. The nominal 10.525 Ghz frequency (or 24.20 Ghz for the K band model) is varied continuously in a 45 MHz band. At any given time there is a difference between the frequencies of transmitted and received target signals. The difference in frequencies is proportional to the distance between the RTMS and the target. The RTMS detects and measures that difference and computes range (distance) to the vehicles and/or stationary objects.

FMCW sets the RTMS apart from other microwave sensors, which use the Doppler effect (frequency shift caused by motion) and can therefore detect only moving targets.

The RTMS detects presence of objects in 2-m (7 ft.) wide radial range slices in the path of the microwave beam. The RTMS microwave beam is 40–45° in height and 15° in width. When pointed onto a roadway, it projects an oval footprint with up to 32 range slices. The width of the footprint depends on the selected mode and varies slightly with the mounting angle of the sensor and position along the oval footprint (i.e., distance from the sensor).

The RTMS can be mounted on the side of the road (Side-Fired configuration) with the oval footprint at a right angle to the traffic lanes. The sliced footprint can provide up to 8 individual detection zones, corresponding to traffic lanes. Detection zones may be defined as one or more range slices. The width of the footprint determines the length of the detection zones.

Vehicle presence in each of the zones is indicated by contact closure and is used to measure volume and occupancy. Average speed is determined from the transit time through the detection zone. Presence of signals outside the detection zones is ignored.

The RTMS can also be mounted in a Forward-Looking configuration with the detection zones aligned along the direction of travel.

The RTMS is thus a radar based multi-lane detection from a single sensor. It enables volume, lane occupancy, speed and simple length classification with tabular interval data collection. It offers low life cycle costs, with simple setup and operation.

Still other Non-Intrusive Traffic Sensors include ultrasonic pulse sensors and Doppler sensors. They provide low cost, single lane detection. They provide accurate detection of vehicles at all speeds including slow speed and stop and go. They provide a vehicle detection trigger (beginning and end) and simple interval counting.

Ultrasonic pulse sensors emit pulses of ultrasonic sound energy and measure the time for the signal to return to the device. Doppler sensors emit a continuous ultrasonic signal and utilize the Doppler principle to measure the shift in the reflected signal.

Still other Non-Intrusive Traffic Sensors include passive infrared devices, which detect the presence of vehicles by comparing the infrared energy naturally emanating from the road surface with the change in energy caused by the presence of a vehicle. Since the roadway may generate either more or less radiation than a vehicle depending on the season, the contrast in heat energy is what is detected.

Still other Non-Intrusive Traffic Sensors include active infrared devices which detect the presence of vehicles by emitting a low-energy laser beam or beams at the road surface and measuring the time for the reflected signal to return to the device. The presence of a vehicle is measured by the corresponding reduction in time for the signal return.

Still other Non-Intrusive Traffic Sensors include Doppler microwave devices which transmit low-energy microwave radiation at a target area on the pavement and then analyse the signal reflected back to the detector. According to the Doppler principle, the motion of a vehicle in the detection zone causes a shift in the frequency of the reflected signal. This can be used to detect moving vehicles and to determine their speed. Radar devices use a pulsed, frequency-modulated or phase-modulated signal to determine the time delay of the return signal, thereby calculating the distance to the detected vehicle. Radar devices have the additional ability to sense the presence of stationary vehicles and to sense multiple zones through their range finding ability. A third type of microwave detector, passive millimeter, operates at a shorter wavelength than other microwave devices. It detects the electromagnetic energy in the millimeter radiation frequencies from all objects in the target area.

Still other Non-Intrusive Traffic Sensors include video devices which use a microprocessor to analyse the video image input from a video camera. Two basic analysis techniques are used: tripline and tracking. Tripline techniques monitor specific zones on the video image to detect the presence of a vehicle. Video tracking techniques employ algorithms to identify and track vehicles as they pass through the field of view. The video devices use one or both of these techniques.

Still other Non-Intrusive Traffic Sensors include passive acoustic devices consisting of an array of microphones aimed at the traffic stream. The devices are passive in that they are listening for the sound energy of passing vehicles. These sensors can be either lane specific or multi-lane. They provide vehicle detection, speed, simple classification, and lane occupancy with tabular data collection by intervals. They are completely passive with no emitted energy.

One such passive acoustic sensor is one which can be mounted on the traffic signalling device or sign and such passive acoustic sensor is the so-called Smart Sonic™ sensor. The SmartSonic™ sensor may be described as including a first acoustic-electric transducer for receiving a first acoustic signal which is radiated from a motor vehicle and for converting the first acoustic signal into a first electric signal that represents the first acoustic signal. The SmartSonic™ also includes a second acoustic-electric transducer for receiving a second acoustic signal which is radiated from the motor vehicle and for converting the second acoustic signal into a second electric signal that represents the second acoustic signal. The SmartSonic™ further includes spatial discrimination circuitry for creating a third electric signal which is based both on the first electric signal and on the second electric signal, that substantially represents the acoustic energy emanating from the zone surrounding the sensor. The SmartSonic™ still further includes frequency discrimination circuitry for creating a fourth signal which is based on the third signal. Finally, the SmartSonic™ includes interface circuitry for creating an output signal which is based on the fourth signal, such that the output signal is asserted when the motor vehicle is within the area surrounding the signal, and such that the output signal is retracted when the motor vehicle is not within the area surrounding the sensor.

Thus, all these non-intrusive detection devices are those devices that cause minimal disruption to normal traffic operations and can be deployed more safely than conventional detection methods. Based on this definition, non-intrusive devices are devices that do not need to be installed in, or on, the pavement but can be mounted overhead, to the side, or beneath the pavement by "pushing" the device in from the shoulder. They are commercially available from the sources set forth in the following table:

| TECHNOLOGY | VENDOR |
|---|---|
| Passive Infrared | Eltec Instruments, Inc. |
| Passive Infrared | ASIM Engineering LTD. |
| Passive Infrared | SANTA FE Technologies, Inc./Titan |
| Active Infrared | Schwartz Electro-Optics, Inc. |
| Active Infrared | Spectra Systems (Manufactured by MBB Business Development GmbH, Germany) |
| Radar | EIS (Electronic Integrated Systems) |
| Doppler Microwave | Microwave Sensors, Inc. |
| Doppler Microwave | Peek Traffic, Inc. |
| Doppler Microwave | Whelen Engineering Co. |
| Pulse Ultrasonic | Novax Industries Corp. |
| Pulse Ultrasonic | Microwave Sensors, Inc. |
| Pulse Ultrasonic | Sumitomo Electric USA, Inc. |
| Passive Acoustic | IRD (International Road Dynamics) |
| Passive Acoustic | SmarTek Systems, Inc. |
| Video | Eliop Trafico |
| Video | Image Sensing Systems |
| Video | Rockwell International |
| Video | Peek Traffic-Transyt Corporation |
| Video | Computer Recognition Systems, Inc. |
| Video | Sumitomo Electric USA, Inc. |
| Video | Automatic Signal/Eagle Signal |
| Video | Condition Monitoring Systems, Inc. |
| Video | Nestor, Inc., Intelligent Sensor Division |

When the traffic sensor is mounted on the sign, the traffic sensor can be an infrared sensor system, as disclosed in U.S. Pat. No. 5,416,711, patented May 16, 1995 by Gron et al.

Intrusive Sensors

When an intrusive traffic sensor is mounted on top of the roadway, it can be a pneumatic road hose, tape switches, piezoelectric sensors, fiber optic sensors, or quartz sensors. Pneumatic road hose is a portable rubber type of hose which is secured on top of the roadway. Tape switches are a relatively old technology. Fiber optic sensors are relatively new and one company which manufactures these is Optical Sensor Systems. Piezoelectric sensors are manufactured by Measurement Specialties Inc. of the U.S., Themocoax of France, and Traffic 2000 of the U.K.

Fiber optic sensors can also be installed in the roadway, either directly into a road cavity or into a frame encasement.

Still other intrusive sensors include passive magnetic devices which measure the change in the earth's magnetic flux created when a vehicle passes through a detection zone. Still other intrusive sensors include active magnetic devices, e.g., inductive loops, which apply a small electric current to a coil of wires and detect the change in inductance caused by the passage of a vehicle.

When the traffic sensor is mounted adjacent the roadway, the traffic sensor can be a flexible carrier comprising an elongated flat elastomeric member having an elongated pressure sensor in a groove in one of its surfaces, as disclosed in U.S. Pat. No. 5,463,385 issued Oct. 31, 1995 to Tyburski.

When the traffic sensor is mounted adjacent the roadway, the traffic sensor can be a coaxial piezoelectric cable having a conducting core, a conducive polymer surrounding the core, a conductive sheath therearound and an electrically non-conductive gasket around the coaxial cable, as taught in U.S. Pat. No. 5,477,217 issued Dec. 19, 1995 to Bergan.

When the traffic sensor is mounted adjacent the roadway, the traffic sensor can be a flanged tube sensor with piezoelectric crystal plates, as taught in U.S. Pat. No. 5,461,924 patented Oct. 31, 1995 by Calderara et al.

When the traffic sensor is mounted adjacent the roadway, the traffic sensor can be the so-called DYNAX™ sensor, which is a force sensing variable resistor which is embedded in a resilient, rubber-like strip that is moulded around the resistor within an elongated sheet metal channel, as disclosed in U.S. Pat. No. 4,799,381, patented Jan. 24, 1989 by Tromp.

The DYNAX™ sensors can also be installed directly into a road cavity and held in place with epoxy, and not only installed in a metal channel.

When the traffic sensor is mounted adjacent the roadway, the traffic sensor can be pressure-sensitive, light-conducting cables, as taught in U.S. Pat. No. 5,020,236, patented Jun. 4, 1991 by Kauer et al.

Some examples of commercially-available such intrusive traffic sensors have been described hereinabove. Other commercially available intrusive detection devices include the following:

| TECHNOLOGY | VENDOR |
|---|---|
| Magnetic | Safetran Traffic Systems, Inc. |
| Magnetic | 3M, Intelligent Transportation Systems |
| Magnetic | Nu-Metrics, Inc. |

Examples of commercially-available such interface controllers are those which are provided by the above suppliers for the non-intrusive sensor. Other generic interface controllers could include traffic counter and classifiers (PEEK, IRD, Diamond Traffic, ITC Golden River), Intersection Controllers (170 Controller) and SCADA devices.

The software which is used is commercially-available under license.

Examples of commercially-available communication devices include Freewave Spread Spectrum Communications devices, WIT Spread Spectrum Transceivers available from Digital Wireless Corporation, Hoplink, available from ENCOM Radio Services Inc., Cellular Modems and Radio Modems.

Examples of commercially-available regulatory signboard with flashers and trailers include those available from NES-WorkSafe of Michigan, Michigan Road Dynamics and Mike Madrid Company of Indianapolis. However, it is standard practice that regulatory signboards with flashers are typically manufactured on a state-by-state or province by province basis by local companies since each state or province is slightly different with respect to standards. Other signs can be electronic message board signs which include VMS (Variable Message Signs) and CMS (Changeable Message Signs). Typical manufacturers include ADDCO of Minnesota, F-P Electronics of Mississauga, Ontario, Infocite of Montreal, Quebec, and FDS (Fiber Display Systems) of Rhode Island, Technologies include incandescent bulbs, flip-disk, LED, LCD, and fiber optic.

The solar panels are usually part of the regulatory signboard and trailer unit. One solar panel manufacturer is Solarex. The solar power equipment and batteries are any types of batteries typically associated with solar power.

In this embodiment of the invention, each communication device includes an antenna. Consequently, line of sight is a requirement of the communication devices since each communications antenna needs to be within view of the other. However, an embodiment of an aspect of this invention may also communicate via cellular modem.

Figure 2:
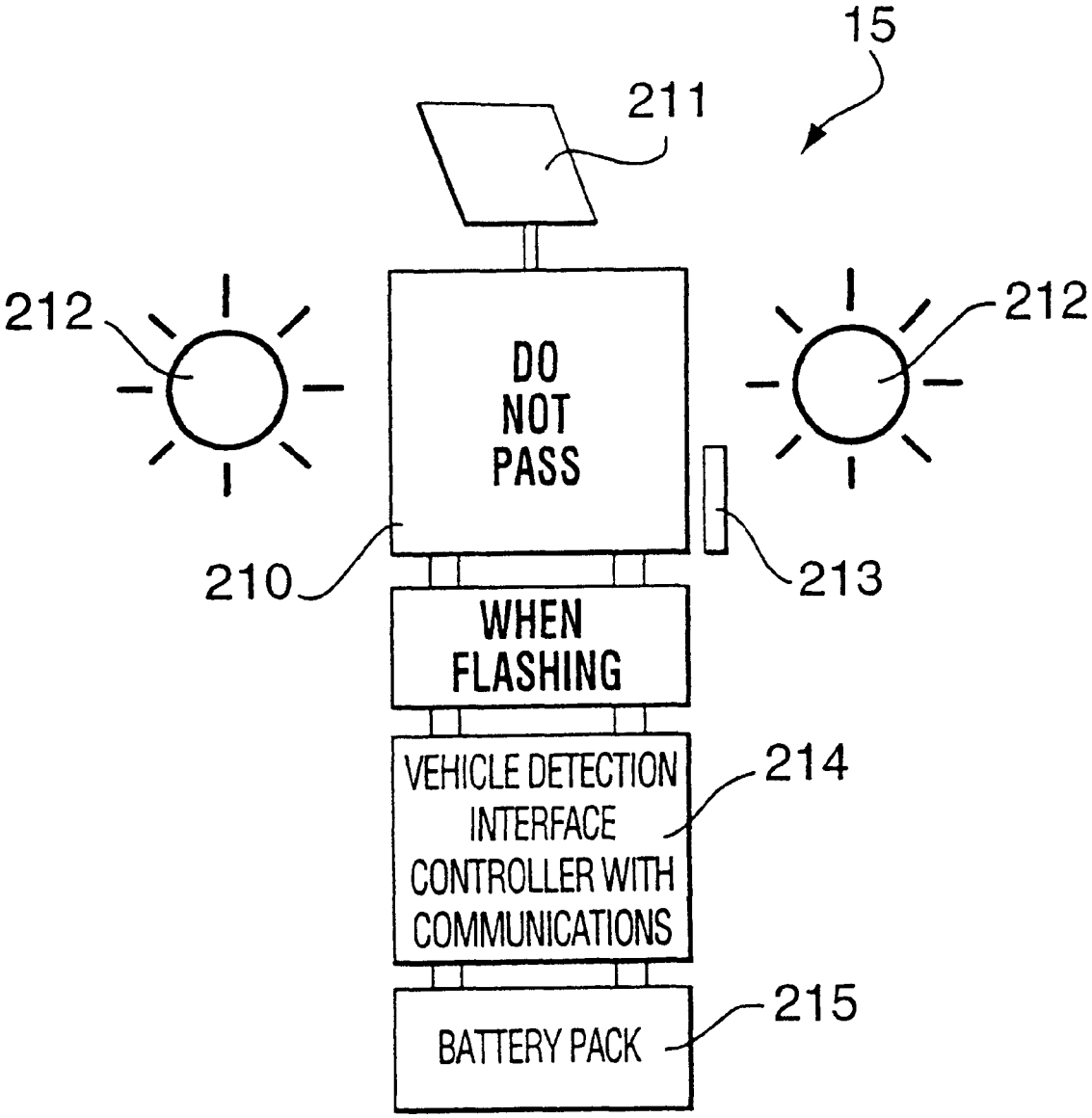
FIG. 2 is a representation of a traffic signalling device, e.g., a sign which is used in embodiments of aspects of this invention.

(b) Description of FIG. 2

FIG. 2 shows one embodiment of a traffic signalling device or warning sign 15. As seen in FIG. 2, the traffic signalling device or sign 15 includes a main body 210 in the form of a standard regulatory sign. While the message on the regulatory sign main body 210 is "DO NOT PASS" other messages, e.g., "MERGE LEFT" or "MERGE RIGHT" may alternatively be displayed. Surmounted atop the main body 210 is a sensor and solar panel 211. A flasher 212 is mounted on each side of the main body 210. The main body 210 is also provided with a vehicle detection interface controller with communications 214. The traffic signalling device or sign 15 is also provided with a battery pack 215. The traffic signalling device or sign may be mounted on a portable trailer (not shown). The traffic signalling device and sign may also be mounted on a roadside pole which is either permanent or portable or an overhead structure (which overhangs the road).

When activated, the traffic signalling device or signs have their lights flashing and display a warning message. Non-activated signs remain blank with their lights turned off.

Figure 3:
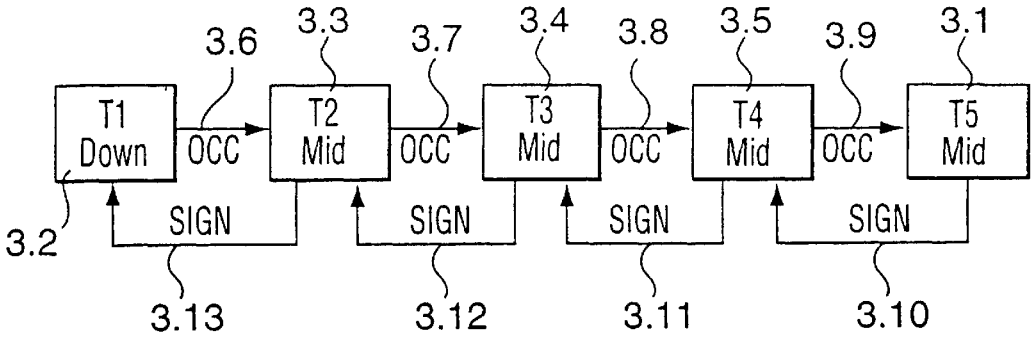
FIG. 3 is a system architecture overall system design according to one embodiment of an aspect of the present invention.

(c) Description of FIG. 3

FIG. 3 shows a site layout of the embodiment of the invention shown in FIG. 1. The site is located just before a construction zone. As shown in FIG. 3, five sub-systems are placed from about one or two thousand feet part, although more or less than five sub-systems may be used. Each system includes a trailer with signs and cabinets containing electronics as shown in block diagram detail in FIG. 2. The trailer closest to the work zone is always a "NO PASSING" or "MERGE LEFT" or "MERGE RIGHT" zone.

As seen in FIG. 3, the system includes an upstream sub-system 3.1, and a downstream sub-system 3.2, with three mid sub-systems 3.3, 3.4 and 3.5 therebetween. Vehicle occupancy signals are cascaded forwardly between the sub-systems, namely: signal 3.6 from sub-system 3.2 to sub-system 3.3; signal 3.7 from sub-system 3.3 to sub-system 3.4; signal 3.8 from sub-system 3.4 to sub-system 3.5; and signal 3.9 from sub-system 3.5 to sub-system 3.1.

Similarly, sign signals are cascaded rearwardly between the sub-systems, namely: signal 3.10 from sub-system 3.1 to sub-system 3.5; signal 3.11 from sub-system 3.5 to sub-system 3.4; signal 3.12 from sub-system 3.4 to sub-system 3.3; and signal 3.13 from sub-system 3.3 to sub-system 3.2.

Figure 4:
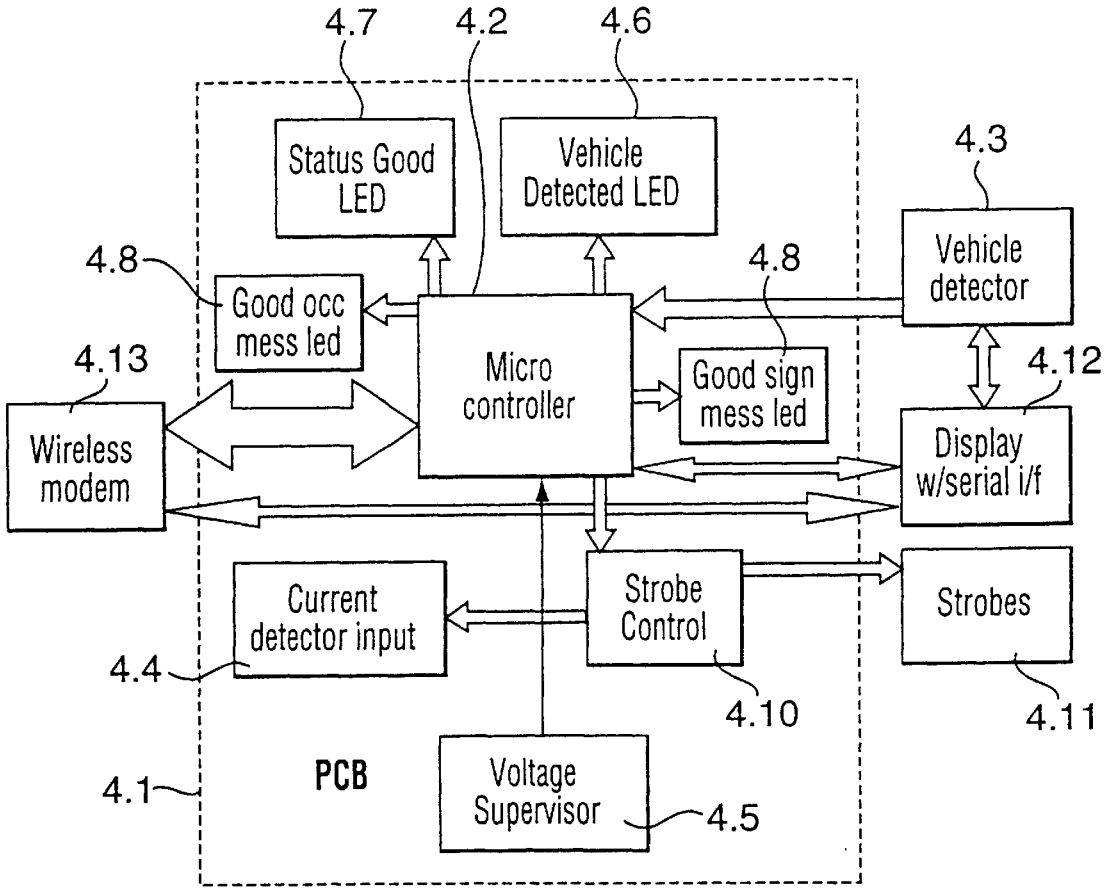
FIG. 4 is a trailer system design according to one embodiment of an aspect of the present invention.

(d) Description of FIG. 4

FIG. 4 shows schematically the components of all sub-systems 3.1, 3.5, 3.4, 3.3 and 3.2, namely, that the components of each sub-system include a vehicle detector, preferably a non-intrusive vehicle detector, a micro controller, an RF modem, a relay, a solar panel, a "DO NOT PASS" or "MERGE LEFT" or "MERGE RIGHT" sign, a battery, a strobe to flash the flashers, diagnostic LEDs, and an override switch. It will be noted, however, that upstream sub-system 3.1 does not include the vehicle detector.

Specifically seen in FIG. 4 is a cabinet 4.1 (shown by broken lines). Within the cabinet 4.1 is a microcontroller 4.2. Microcontroller 4.2 receives external signals from the vehicle detector 4.3, and internal signals from the current detector input 4.4, and the voltage supervisor 4.5. Microcontroller 4.2 provides signals to several LED displays, namely: "vehicle detected" LED 4.6; "status good" LED 4.7; "good occupancy message" LED 4.8; and "good sign message" LED 4.9. Microcontroller 4.2 provides a control signal to the strobe control 4.10, which provides a signal to operate the strobes 4.11. In addition, the strobe control 4.10 provides a feedback signal to the current detector input 4.4. The microcontroller finally is connected by two way signals, either RX, TX, DTR or CD to a wireless modem 4.13.

The vehicle detector 4.3 may also be connected two-way to a display 4.12. Display 4.12 may also be connected two-way to microcontroller 4.2 and to wireless modem 4.13.

Figure 5:
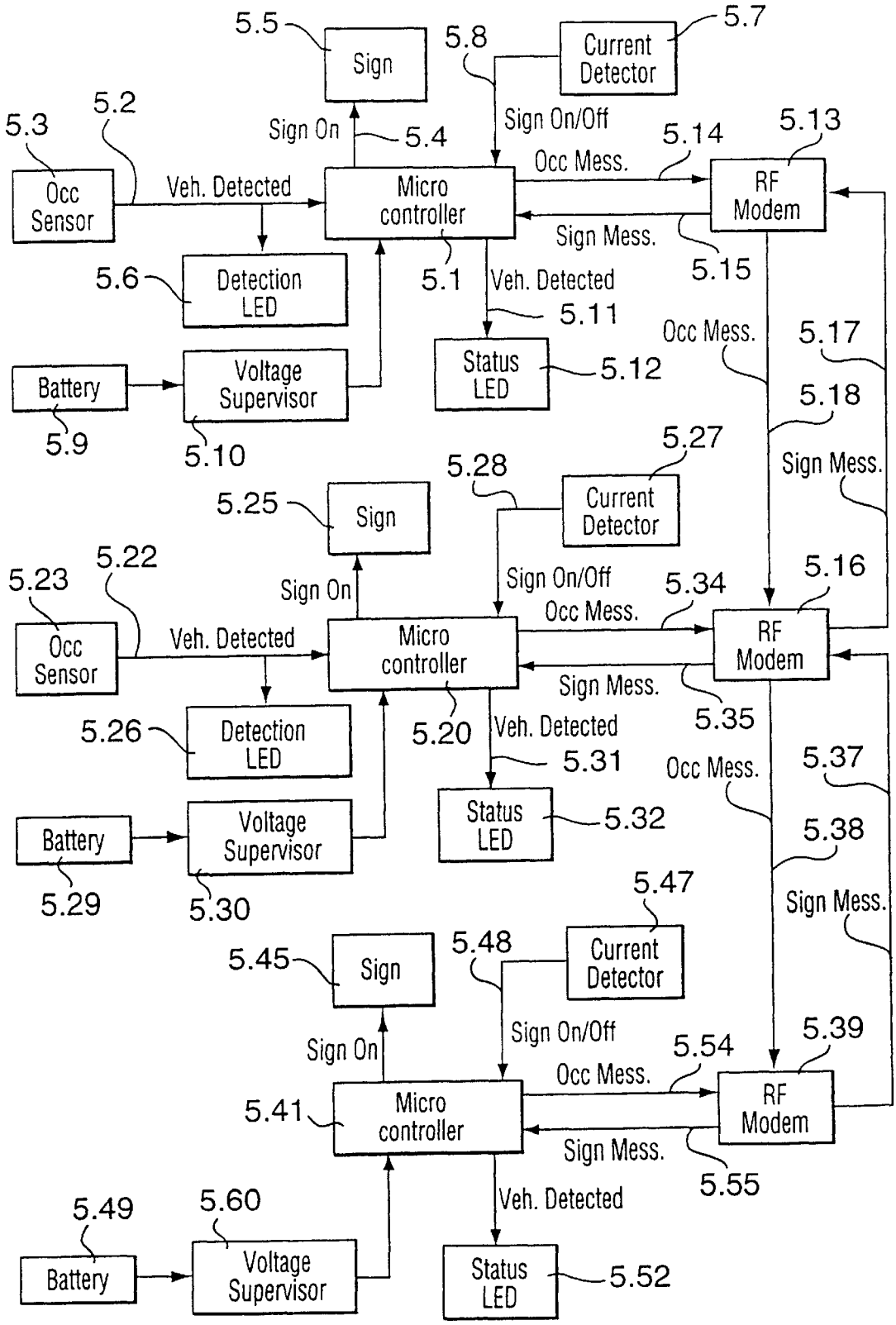
FIG. 5 is a process and/or data flow diagram according to one embodiment of an aspect of the present invention.

(e) Description of FIG. 5

FIG. 5 shows one embodiment of electronic interconnections between three sub-systems, e.g., 3.4, 3.5, and 3.1.

In the first electrically-linked sub-system, e.g., 3.4, first microcontroller 5.1 receives a "vehicle detection" signal 5.2 from the occupancy sensor 5.3 and sends a "sign on" signal 5.4 to the sign 5.5. The occupancy sensor 5.3 also is connected to a detection LED 5.6. A current detector 5.7 provides a "sign on/off" signal 5.8 to the microcontroller.

The microcontroller 5.1 receives power from a battery 5.9 and voltage supervisor 5.10.

Upon a detection of a vehicle, the microcontroller 5.1 provides a "vehicle detected" signal 5.11 to a status LED 5.12.

A first RF modem 5.13 is interconnected electrically to first microcontroller 5.1 to receive an "occupancy message" signal 5.14 and to transmit a "sign message" signal 5.15. RF modem 5.13 is, in turn, interconnected electrically to a second RF modem 5.16, which first transmits a "sign message" signal 5.17 to first RF modem 5.13 and receives an "occupancy message" signal 5.18 from first RF modem 5.13.

In the second electrically-linked sub-system, e.g., 3.5, a second microcontroller 5.21 receives a "vehicle detection" signal 5.22 from the occupancy sensor 5.23 and sends a sign or signal 5.24 to the sign 5.25. The occupancy sensor 5.23 also is connected to a detection LED 5.26. A current detector 5.27 provides a "sign on/off" signal 5.28 to the microcontroller.

The second microcontroller 5.21 receives power from a battery 5.29 and voltage supervisor 5.30.

Upon detection of a vehicle the second microcontroller 5.21 provides a vehicle detected signal 5.31 to a status LED 5.32.

The second RF modem 5.16 is electrically-interconnected to the second microcontroller 5.21 to receive an "occupancy message" signal 5.34 and to transmit a "sign message" signal 5.35. Second RF modem 5.16 is, in turn, electrically-interconnected to a third RF modem 5.39, which transmits a "sign message" signal 5.37 to second RF modem 5.16, and receives "an occupancy message" signal 5.38 from second RF modem 5.16.

In the third electrically-linked sub-system, e.g., 3.1, a third microcontroller 5.41 receives an "occupancy message" signal 5.54 from third RF modem 5.39 and sends a "sign on" signal 5.44 to the sign 5.45. A current detector 5.47 provides a "sign on/off" signal 5.48 to the third microcontroller 5.41.

The third microcontroller 5.41 receives power from a battery 5.49 and voltage supervisor 5.60.

DESCRIPTION OF OPERATION OF THE INVENTION

In summary, therefore, according to one embodiment of this invention, the work zone safety system uses a non-intrusive vehicle detector to detect traffic, a micro controller to control relays and interpret up and/or downstream messages, a wireless modem to communicate between up and/or downstream systems, and relays to control the flashing lights on the "DO NOT PASS" or "MERGE LEFT" or "MERGE RIGHT" sign. The non-intrusive vehicle detector detects vehicle presence in a configurable zone. It processes the presence information and outputs the information on contact closures.

The contact closure output is fed into one of the inputs of the microcontroller. The measured occupancy is compared to the occupancy threshold to create a message that is transmitted to the upstream unit at the end of the occupancy period. One serial port of the microcontroller is used to send and receive messages from up and/or downstream microcontrollers through a transceiver, e.g., a FREEWAVE™ transceiver. If an "occupancy high" message is received, then the microcontroller updates the occupancy on time and activates a relay that controls the flashers for the suitable warning, e.g., "DO NOT PASS" or "MERGE LEFT" or "MERGE RIGHT" sign. Finally the microcontroller monitors the output of a current detector to ensure that the sign is functioning properly.

The wireless modem has one serial port, one RF port, and diagnostic LEDs. The serial port takes data from the serial port of the microcontroller and transmits the data out the RF port. The data out the RF port is received either up or downstream.

The relay takes input form the microcontroller. The relay turns the flashers on or off based on the input. The relay will provide a high current DC contact to control the flashers.

In the event of a relay failure, the "status good" LED extinguishes to indicate that a failure has occurred. Other LEDs indicate whether occupancy and sign messages have been received appropriately and whether a vehicle has been detected.

In the operation of the system, traffic sensors detect long vehicle queues. A dynamic "NO PASSING" or "MERGE LEFT" or "MERGE RIGHT" zone is created using trailer-mounted signs. Infractions can be enforced with traffic citations.

The dynamic work zone system of aspects of this invention is a traffic control product for construction work zones that assists in the prevention of dangerous merging which occurs on the tapered approaches to work zones, provides safer work zones reduces driver rage and smooths traffic flow and reduces congestion.

Based on vehicle congestion measured at several locations approaching the work zone, the dynamic work zone expands and shrinks creating a "NO PASSING" or "MERGE LEFT" or "MERGE RIGHT" zone prior to the construction zone appropriate for the current level of traffic. This directs all traffic into the lane that will continue past the work site at a point where lane changes are safer and easier. This eliminates traffic conflicts that occur when traffic stays in the closed lane until the last moment and facilitates smoother traffic flow. It also reduces the anxiety of other drivers and decreases travel time for vehicles in the continuing lane. The equipment is solar and/or battery powered and trailer mounted making it fully portable for quick deployment or relocation as the construction site progresses or changes. Alternatively, the equipment may be mounted on a roadside pole or overhead structure.

Thus the present invention provides a method of traffic control for a construction work zone that assists in the prevention of dangerous merging which occurs on the tapered approaches to work zones. The method of traffic control includes the first step of establishing a first "NO PASSING" or "MERGE LEFT" or "MERGE RIGHT" zone immediately upstream of a construction work zone. Then the method of traffic control includes the second step of detecting and measuring traffic congestion at a plurality of locations approaching the first "NO PASSING" or "MERGE LEFT" or "MERGE RIGHT" zone. The method of traffic control then includes the step of determining, by means of software, the length of a "NO PASSING" or "MERGE LEFT" or "MERGE RIGHT" zone based on the detected traffic congestion. Then, based on the length of a traffic queue, the method of traffic control automatically, by means of the software, expands or shrinks a "NO PASSING" or "MERGE LEFT" or "MERGE RIGHT" zone upstream of the construction work zone appropriate for the measured level of traffic. Additional information signs may be complementary to the signs provided by this invention.

In general terms, the novel dynamic work zone safety system of a broad aspect of this invention includes a first traffic signalling device which is positioned along a roadside immediately upstream of a point where traffic is diverted to a single lane. The first traffic signalling device is defaulted to flash a suitable warning, e.g., "DO NOT PASS" or "MERGE LEFT" or "MERGE RIGHT" warning, thereby to provide a first "NO PASSING" or "MERGE LEFT" or "MERGE RIGHT" zone which is defined by the distance between the first traffic signalling device and the end of a work or construction zone. A second traffic signalling device is positioned alongside a roadside at a predetermined distance upstream of the first traffic signalling device. The second traffic signalling device is defaulted not to flash a suitable warning, e.g., a "DO NOT PASS" or "MERGE LEFT" or "MERGE RIGHT" warning. However, when activated (by processor-controlled means defined herein) to flash a suitable warning, e.g., "DO NOT PASS" or "MERGE LEFT" or "MERGE RIGHT", the second traffic signalling device provides a second "NO PASSING" or "MERGE LEFT" or "MERGE RIGHT" zone which is contiguous to the first "NO PASSING" or "MERGE LEFT" or "MERGE RIGHT" zone. This lengthens the "NO PASSING" or "MERGE LEFT" or "MERGE RIGHT" zone between the second traffic signalling device and the end of the work or construction zone. A plurality of spaced-apart sensors, preferably non-intrusive traffic sensors, is disposed along the roadway both downstream of, and upstream of, the second traffic signalling device. These sensors detect and determine the length of a traffic queue upstream of the first traffic signalling device between the first traffic signalling device and the second traffic signalling device. The sensors then provide a signal which is representative of the length of the traffic queue. The processor receives the traffic queue signal and generates a first activation signal to activate the second traffic signalling device when the traffic queue reaches a predetermined length. It also generates a first deactivation signal to deactivate the second traffic signal when the traffic queue is less than the predetermined length. This dynamically increases or decreases the "NO PASSING" or "MERGE LEFT" or "MERGE RIGHT" zone.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A dynamic work zone safety system comprising:

(a) a first traffic signalling device which is positioned along a roadside immediately upstream of a point where traffic is diverted to a single lane, said first traffic signalling device being defaulted to flash a suitable warning, "DO NOT PASS" or "MERGE LEFT" or "MERGE RIGHT", thereby to provide a first "NO PASSING" or "MERGE LEFT" or "MERGE RIGHT" zone which is defined by the distance between said first traffic signalling device and the end of said work or construction zone;

(b) a second traffic signalling device which is positioned alongside a roadside a predetermined distance upstream of said first traffic signalling device, said second traffic signalling device being defaulted not to flash a suitable warning, "DO NOT PASS" or "MERGE LEFT" or "MERGE RIGHT", but, when activated, flashes a suitable warning, "DO NOT PASS" or "MERGE LEFT" or "MERGE RIGHT", thereby providing a second "NO PASSING" or "MERGE LEFT" or "MERGE RIGHT" zone which is contiguous to said first "NO PASSING" or "MERGE LEFT" or "MERGE RIGHT" zone, thereby to lengthen the "NO PASSING" or "MERGE LEFT" or "MERGE RIGHT" zone to between said second traffic signalling device and the end of said work or construction zone;

(c) a plurality of spaced-apart sensors along the roadway both downstream of, and upstream of, said second traffic signalling device, to detect and determine the length of a first traffic queue upstream of said first traffic signalling device between said first traffic signalling device and said second traffic signalling device, and to provide a first signal which is representative of the length of said first traffic queue; and (d) a processor which are loaded with a suitable computer program for receiving said first traffic queue signal and for generating a first activation signal to activate said second traffic signalling device when said first traffic queue reaches a predetermined length, and for generating a first deactivation signal to deactivate said second traffic signal when said first traffic queue is less than said predetermined length;

thereby dynamically increasing or decreasing said "NO PASSING" or "MERGE LEFT" or "MERGE RIGHT" zone.

2. The dynamic work zone safety systems of claim 1, including:

(e) a third traffic signalling device, said third traffic signalling device being positioned alongside a roadside a predetermined distance upstream from said second traffic signalling device, and whereby:

(i) when said third traffic signalling device is activated, a third "NO PASSING" or "MERGE LEFT" or "MERGE RIGHT" zone is created which is contiguous to said second "NO PASSING" or "MERGE LEFT" or "MERGE RIGHT" zone, thereby to lengthen the said second "NO PASSING" or "MERGE LEFT" or "MERGE RIGHT" zone to a third "NO PASSING" or "MERGE LEFT" or "MERGE RIGHT" zone between said third traffic signalling device and the end of said work or construction zone;

wherein said plurality of spaced-apart sensors (c) further includes:

(ii) a first additional plurality of spaced-apart sensors along the roadway both upstream of, and downstream of, said third traffic signalling device to detect and determine the length of a second traffic queue upstream of said first traffic signalling device between said second traffic signalling device and said third traffic signalling device, and to provide a second traffic queue signal which is representative of said second traffic queue; and wherein said processor (d) is also configured to:

(iii) generate a second activation signal to activate said third traffic signalling device when said second traffic queue reaches a predetermined length, and to generate a second deactivation signal to deactivate said third traffic signal when said second traffic queue is less than said predetermined length, thereby dynamically increasing or decreasing said third "NO PASSING" or "MERGE LEFT" or "MERGE RIGHT" zone.

3. The dynamic work zone safety systems of claim 2, including:

(e) an "nth" traffic signalling device, said "nth" traffic signalling device being positioned alongside a roadside a predetermined distance upstream from said third traffic signalling device, and whereby:

(i) when said "nth" traffic signalling device is activated, a fourth "NO PASSING" or "MERGE LEFT" or "MERGE RIGHT" zone is created which is contiguous to said third "NO PASSING" or "MERGE LEFT" or "MERGE RIGHT" zone, thereby to lengthen said "NO PASSING" or "MERGE LEFT" or "MERGE RIGHT" zone to a fourth "NO PASSING" or "MERGE LEFT" or "MERGE RIGHT" zone between said "nth" traffic signalling device and the end of said work or construction zone;

wherein said plurality of spaced-apart sensors (c) further includes:

(ii) a second additional plurality of spaced-apart sensors along the roadway both upstream of, and downstream of, said "nth" traffic signalling device to detect and determine the length of a third traffic queue upstream of said first traffic signalling device between said third traffic signalling device and said "nth" traffic signalling device, and to provide a fourth traffic queue signal which is representative of said fourth traffic queue; and wherein said processor (d) is also configured to:

(iii) generate a third activation signal to activate said "nth" traffic signalling device when said third traffic queue reaches a predetermined length, and to generate a third deactivation signal to deactivate said "nth" traffic signal when said third traffic queue is less than said predetermined length, thereby dynamically increasing or decreasing said fourth "NO PASSING" or "MERGE LEFT" or "MERGE RIGHT" zone.

4. The dynamic work zone safety system of claim 3, wherein said sensors are integrated with said traffic signalling devices.

5. The dynamic work zone safety system of claim 3, wherein said processor is connected to said traffic signalling devices wirelessly.

6. The dynamic work zone safety system of claim 2, wherein said sensors are integrated with said traffic signalling devices.

7. The dynamic work zone safety system of claim 2, wherein said processor is connected to said traffic signalling devices wirelessly.

8. The dynamic work zone safety system of claim 1, wherein said sensors are integrated with said traffic signalling devices.

9. The dynamic work zone safety system of claim 1, wherein said sensors are non-intrusive.

10. The dynamic work zone safety system of claim 9, wherein said non-intrusive sensors are active radar sensors.

11. The dynamic work zone safety system of claim 10, wherein said non-intrusive sensors are passive acoustic sensors.

12. The dynamic work zone safety system of claim 10, wherein said non-intrusive sensors are ultrasonic sensors.

13. The dynamic work zone safety system of claim 1, wherein said sensors are intrusive.

14. The dynamic work zone safety system of claim 13, wherein said intrusive sensors comprises a sensor which is mounted onto the roadway and which is a pneumatic road hose, a tape switch, a piezoelectric sensor, a fiber optic sensor or a quartz sensor.

15. The dynamic work zone safety system of claim 13, wherein said intrusive sensors comprises a passive magnetic device, an active magnetic device or an inductive loop.

16. The dynamic work zone safety system of claim 13, wherein said intrusive sensors comprises an elongated elastomeric member having an elongated pressure sensor thereon, a coaxial piezoelectric cable, a flanged tube sensor with piezoelectric plates or a DYNAX™ sensor.

17. The dynamic work zone safety system of claim 1, wherein said processor is connected to said traffic signalling devices wirelessly.

18. The dynamic work zone safety system of claim 1, wherein said sensors are at least one of solar powered and battery powered.

19. A method of traffic control for a construction work zone that assists in the prevention of dangerous merging which occurs on the tapered approaches to work-zones which comprises:

(A) establishing a first "NO PASSING" or "MERGE LEFT" or "MERGE RIGHT" zone immediately upstream of said construction work zone;

(B) detecting and measuring traffic congestion at a plurality of locations approaching said first "NO PASSING" or "MERGE LEFT" or "MERGE RIGHT" zone as a first traffic queue; and (C) determining, by means of software, the length of a "NO PASSING" or "MERGE LEFT" or "MERGE RIGHT" zone based on said detected traffic congestion, and based, on the length of said first traffic queue, automatically, by means of said software, expanding or shrinking said "NO PASSING" or "MERGE LEFT" or "MERGE RIGHT" zone upstream of said construction work zone appropriate for said measured level of traffic congestion.

* * * * *